United States Patent [19]

Shillum

[11] 4,064,996

[45] Dec. 27, 1977

[54] RACK SYSTEM

[75] Inventor: Robert L. Shillum, 12 Tupper Court, Kitchener, Ontario, Canada

[73] Assignee: Robert L. Shillum, Kitchener, Ontario, Canada

[21] Appl. No.: 641,414

[22] Filed: Dec. 17, 1975

[51] Int. Cl.[2] ..... A47B 43/00

[52] U.S. Cl. ..... 211/191; 248/243; 108/107

[58] Field of Search ..... 211/187, 190–192; 248/243; 108/107

[56] References Cited

U.S. PATENT DOCUMENTS

| | | | |
|---|---|---|---|
| 2,893,567 | 7/1959 | Steele | 211/191 |
| 3,151,745 | 10/1964 | Reilly | 211/191 |
| 3,278,043 | 10/1966 | Kimpton | 211/191 |
| 3,606,027 | 9/1971 | Clements | 211/191 |

FOREIGN PATENT DOCUMENTS

| | | | |
|---|---|---|---|
| 446,644 | 3/1968 | Switzerland | 211/192 |

*Primary Examiner*—Roy D. Frazier

*Assistant Examiner*—Terrell P. Lewis

[57] ABSTRACT

The invention provides a combination of a post and an end connector for use in a rack system to support shelves and the like. The posts have first and second side ribs extending longitudinally and center portions extend between the side ribs. Each center portion defines longitudinally spaced slots and the side ribs are disposed symmetrically to either side of the center portions. The end connector has a channel shape adapted to fit snugly over a side rib of one of the posts. Coupling elements extend from the channel shape and each has a cantilever portion and a downward projection dependent from an end of the cantilever portion. The projection defines a rearward face inclined downwardly and rearwardly for engagement with a rearward side of the center portion of the post after engaging the coupling element in the post. Consequently a downward force on the end connector will result in a wedging action as the rearward faces of coupling elements ride on the center portion thereby drawing the end connector into firm and snug engagement with the corresponding side rib of the post.

4 Claims, 8 Drawing Figures

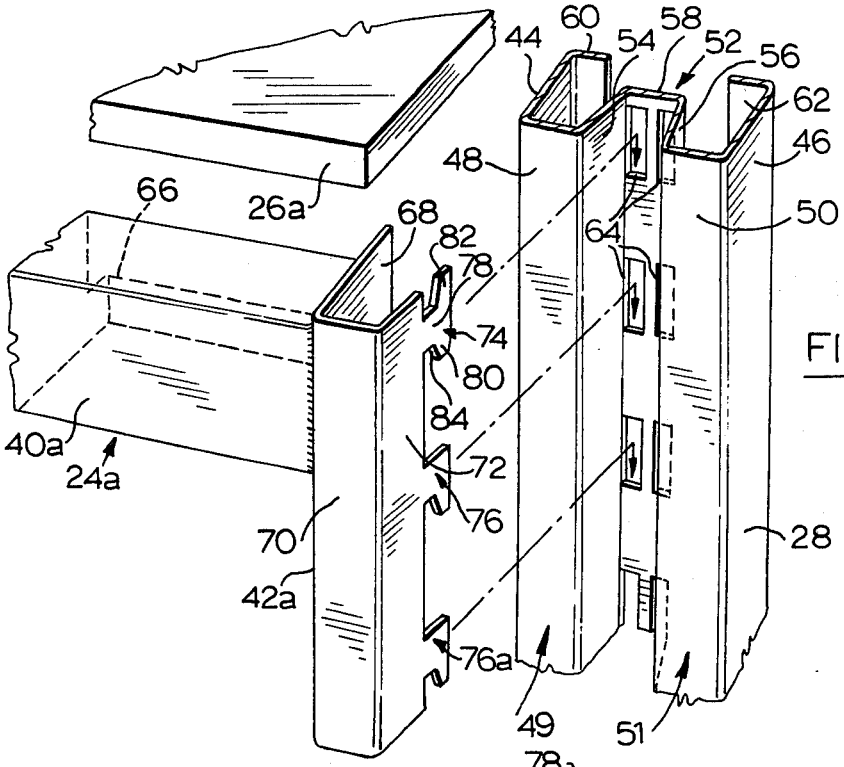
FIG. 2
FIG 7
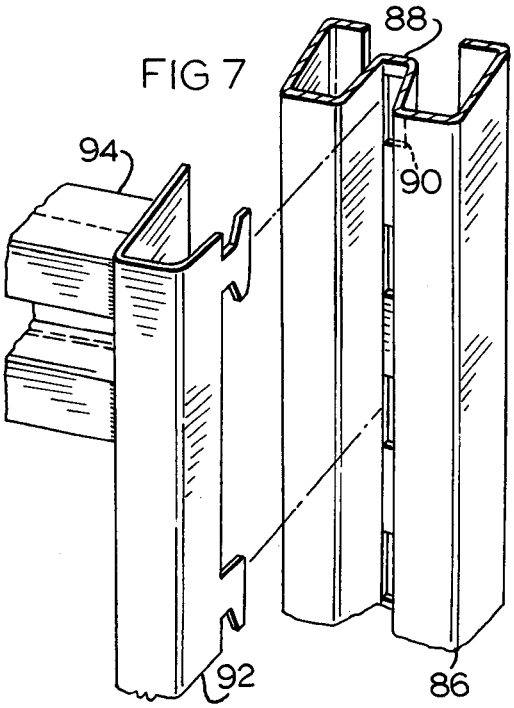
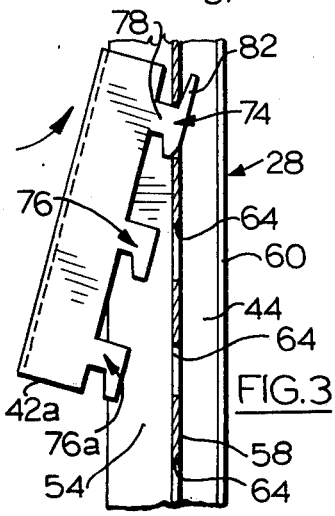
FIG. 3
FIG. 4
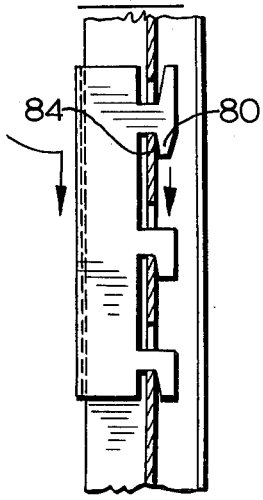
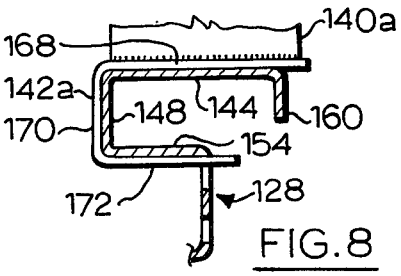
FIG. 8
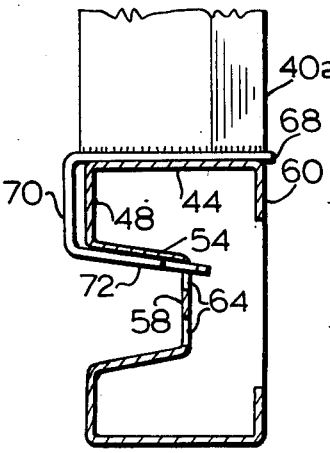
FIG. 5
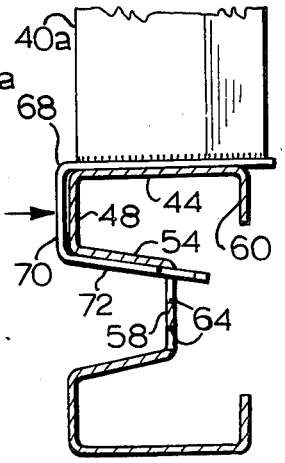
FIG. 6

RACK SYSTEM

This invention relates to rack systems and more particularly to a connection between a shelf support element and a post of such a system.

Rack systems are used for storing many varied products in warehouses, stockrooms and the like. It is common nowadays for such systems to extend the full height of a building and to be arranged in rows providing space for unloaders to move between the rows. The unloaders can remove stock from shelves in the system and then transfer the stock to a central location for processing.

There are a number of design criteria which rack systems should meet. These criteria are becoming more rigorous as the height of the rack systems is increased. Safe-guards against collapse must be met by the design criteria so that a positive lock between elements is essential. It is also preferable that the system be designed to avoid accidental dislocation of shelves from the posts supporting the shelves. Further, economic considerations dictate that maximum rigidity should be achieved using a minimum of materials and a minimum of assembly operations.

Present rack systems generally use simple hook arrangements to permit elements of a shelf to be hooked onto a post. In many instances the elements can be dislocated accidentally and are therefore not entirely acceptable. Further, it is common to perforate the posts for receiving the hook elements and the perforations are commonly placed on the front of the post. This is the portion of the post which receives the most stress caused by bending forces and consequently the cross-section of metal used must be increased to compensate for the weakness caused by the perforations.

In one aspect, the invention provides a rack system having a positive yet releasable lock between posts and shelf elements to thereby create a relatively strong and stable rack system.

In another aspect, the invention provides a combination of a post and an end connector for use in a rack system to support shelves and the like. The posts have first and second side ribs extending longitudinally and centre portions extend between the side ribs. Each centre portion defines longitudinally spaced slots and the side ribs are disposed symmetrically to either side of the centre portions. Each side rib includes an outer portion lying generally perpendicularly to a plane containing the centre portion, a front portion lying generally parallel to the centre portion, and a side portion extending from the front portion to the centre portion. The end connector has a channel shape adapted to fit snugly over a side rib of one of the posts. The channel shape is defined by first and second side portions and a front portion extending between these side portions and the end connector further comprises first and second coupling elements extending rearwardly from the second portion for engagement in said slots. Each of the coupling elements has a cantilever portion and a downward projection dependent from an end of the cantilever portion and defines a rearward face inclined downwardly and rearwardly for engagement with a rearward side of the centre portion of the post after engaging the coupling element in the post. Consequently a downward force on the end connector will result in a wedging action as the rearward faces of coupling elements ride on the centre portion thereby drawing the end connector into firm and snug engagement with the corresponding side rib of the post.

These and other aspects of the invention will be better understood with reference to the drawings, in which:

FIG. 2 is an exploded perspective view of a portion of the rack system and illustrating an end connector about to be engaged in a post;

FIGS. 3 and 4 are sectional side views illustrating the assembly of the end connector and post shown in FIG. 2;

FIGS. 5 and 6 are sectional plan views which also illustrate the assembly of the parts shown in FIG. 2;

FIG. 7 is a view similar to FIG. 2 showing alternative embodiments of the parts shown in FIG. 2; and FIG. 8 is a view similar to FIG. 6 showing a further embodiment of the post.

Figure 1:
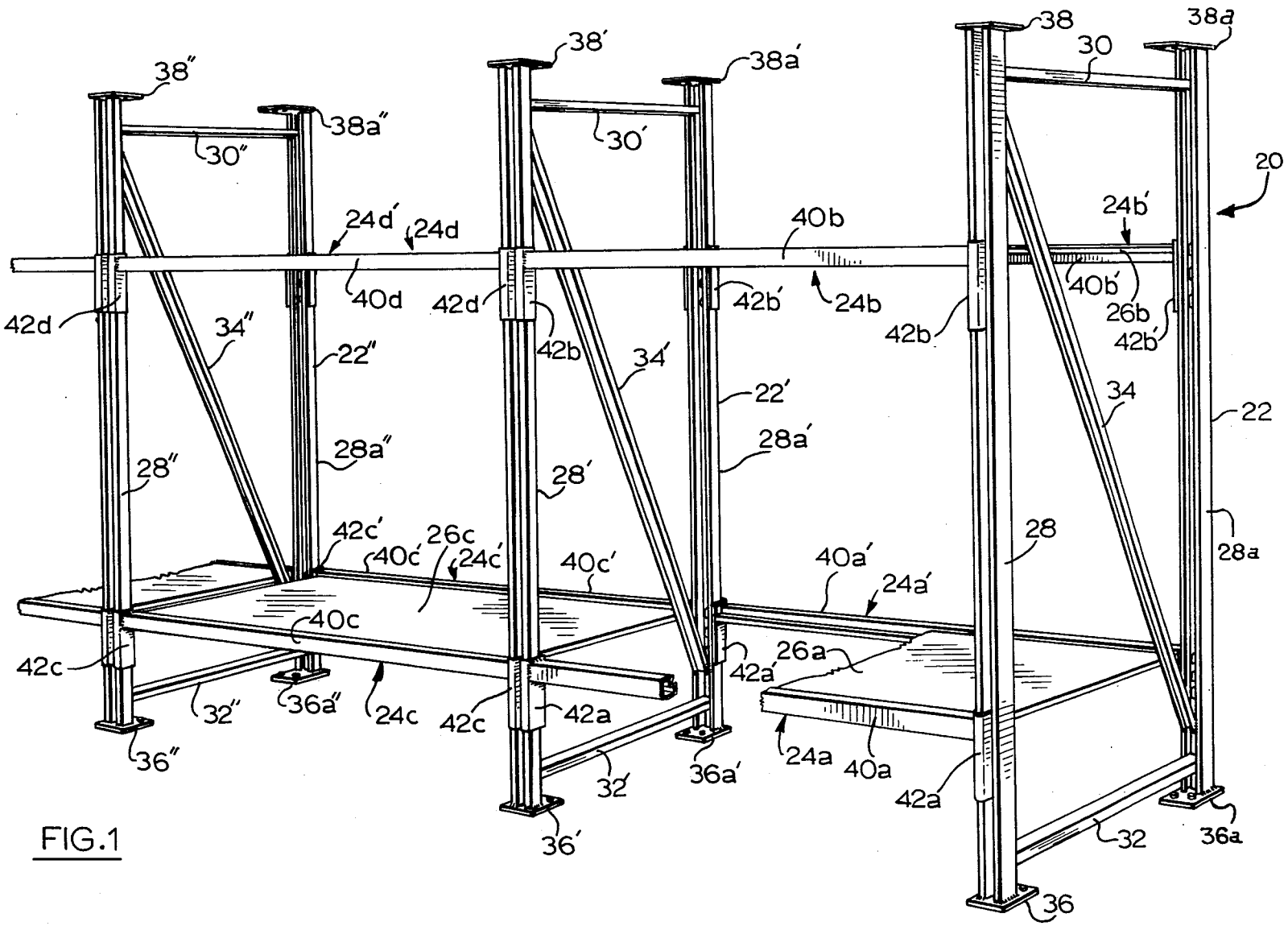
FIG. 1 is a perspective view of a section of a rack system incorporating the invention.

Reference is first made to FIG. 1 in which a rack system is identified generally by the numeral 20. The system consists of a plurality of vertically orientated support frames of which support frames 22, 22' and 22'' are typical. The frames are spaced apart sufficiently to receive pairs of shelf support elements such as elements *24a*, *24a'*; *24b*, *24b'*; *24c*, *24c'*, *24d*, *24d'*. The numbered support elements support shelves *26a*, *26b*, *26c*, and a further shelf between elements *24d* and *24d'* which is not seen in this figure.

Support frame 22 is typical of all the support frames and will be described in more detail. Parts of frames 22' and 22'' which correspond to the parts described with reference to frame 22 will be identified using corresponding prime and double prime numerals. Support frame 22 consists of a pair of upright posts 28, *28a*, which are of similar construction and have corresponding parts facing one another. The posts are maintained in parallel spaced relationship by respective horizontal top and bottom braces 30, 32 and an inclined cross brace 34. The posts also have respective foot plates 36, *36a* and corresponding head plates 38, *38a*. The shelf support element *24a* is typical of the other shelf support elements previously introduced. This element includes a stringer *40a* extending between a pair of opposite-handed end connectors *42a* which are releasably connected to the respective posts 28 and 28' as will be described more fully with reference to subsequent figures. Similar stringers and end connectors are used in the structure of the other shelf support elements and are indicated by corresponding numerals using primes and suffices to differentiate the parts from one another.

As seen in FIG. 1, the shelf *26a* is supported by the shelf support element *24a* which is assembled on the post 28. Detail of this exemplary connection is shown in FIG. 2 and reference is now made to this figure to describe the interconnection between support elements and posts generally, with particular reference to the element *24a* and post 28.

As seen in FIG. 2, the post 28 is symmetrical about a longitudinal axis and is roll formed to define a pair of parallel outer portions 44, 46 dependent from coplanar front portions 48, 50. In turn, the portions 48, 50 are dependent from converging side portions 54, 56 which extend from inner extremities of the front portins 48, 50. The portions 44, 48 and 54 combine to define a first llongitudinally extending rib 49, and a second such rib 51 is defined by portions 46, 50 and 56.

The side portions 54, 56 depend from a centre portion 58 which is parallel to the front portions 48, 50 and spaced from these portions by a distance equal to about half of the transverse extent of one of the similar outer portions 44, 46. The cross-section of the post 28 is completed by respective rear flanges 60, 62 which are dependent from portions 44, 46 and lie in parallel arrangement with the front portions 48, 50. Inwardly facing extremities of these flanges provide support for receiving and welding the braces 30, 32 and 34 (FIG. 1).

After roll forming, the post 22 is punched to define pairs of rectangular slots 64 which are arranged at regular intervals along the length of the post 28 for interconnection with the end connector **42*a*** as will be described.

As seen in FIG. 2, the stringer **40*a* is welded to the end connector 42*a* adjacent an upper extremity of the connector. The stringer 40*a* is roll formed into a generally L-shaped cross-section for providing a step 66 (shown in ghost outline) which supports a portion of the shelf 26*a*. The end connector 42*a* extends downwards from the horizontal stringer 40*a* and includes a first portion 68 to which the stringer 40*a* is attached. The portion 68 lies at right angles to the stringer 48 and extends from a front portion 70 which is generally perpendicular to the portion 68 and from which a second portion 72 depends. This last portion diverges rearwardly with respect to the first portion 68. The angle of divergence and the proportions of the connector 42*a* are such that a channel is formed which will fit snugly over rib 49 of the post 28 with the respective first and second portions 68, 72 in face-to-face engagement with outer portion 44 and side portion 54 of the post 28. This will be more fully explained with reference to FIGS. 5 and 6**.

The end connector **42*a* also includes a first coupling element 74 dependent rearwardly from the second portion 72 and coplanar therewith. Similarly, a pair of second coupling elements 76, 76*a* depend from the portion 72 for combining with the element 74 to attach the connector 42*a* to the post 28. This connection will subsequently be more fully explained with reference to FIGS. 3 and 4**.

The first coupling element 74 consists of a cantilever portion 78 which terminates in a downward projection 80 and an upward projection 82. A forward or outer face 84 of the projection 80 extends downwardly and rearwardly for use in a wedging action as will be described with reference to FIGS. 3 and 4. The second coupling elements **76, 76*a* are similar in all respects to the first coupling element 74 with the exception that the upward projection 82** is omitted.

Reference is now made to FIG. 3 to better describe the interconnection between the end connector **42*a* and the post 28**.

The first coupling element 74 and the pair of second coupling elements **76, 76*a* are spaced from one another by a distance equal to the corresponding spacing between slots 64 in the post 28. The end conductor 42*a* will be engaged in the post 28 at the same time as the other end connector 42*a* (FIG. 1) is engaged in the post 36*a*. The shelf support element 24*a* is tipped into the position shown in FIG. 3 so that the upward projection 82 of the element 74 can be entered ino one of the slots 64. By engaging an upward extremity of the cantilever portion 78 of element 74 against an upper extremity of the slot, the shelf support element can then be rotated downwardly towards the post 28 to enter the second coupling elements 76, 76*a* into the pair of openings immediately below the opening containing the first coupling element 74. The proportions of the elements 74, 76 and 76*a* are such that they will pass through the openings 64 with adequate clearance. Shelf support element 24*a* is then allowed to move downwardly towards the position shown in FIG. 4**.

After the coupling elements 74, 76 and **76*a* are engaged in slots 64 of the post, the end connector 42*a* is initially in the position shown in FIG. 5. As the downward movement of the end connector commences, the rearward face 84 of the downward projection 80 engages the centre portion 58 below the corresponding slot and similar faces on the second coupling elements 76, 76*a* also engage the centre portion 58. Consequently, because of the angle of these faces a downward force will create a component which draws the end connector 42*a* into firm engagement with the post 28. As seen in FIG. 4** the wedging action has been completed before the cantilever portions of the coupling elements meet the bottom extremities of the respective slots containing these elements.

As illustrated in FIG. 6, the downward movement which results in drawing the end connector **42*a* into firm engagement with the post 28*a* is limited by the engagement of the diverging first and second portions 68, 72 of the end connector 42*a* with the corresponding outer portion 44 and side portion 54 of the post 28. Here again there is a wedging action which results in firm engagement between these parts and any further load on the end connector 42*a* will simply result in firmer engagement between this connector and the post 28**.

Returning to FIG. 3, the upward projection 82 of the first coupling element 74 is used initially to engage the end connector **42*a* in the post 28 as described. However, after assembly, in the event that the shelf supporting element 24*a* is dislodged upwardly by a fork lift truck or the like, then the upward projection 82 will prevent the end connector 42*a* from falling off the post 28. Once the upward force is removed the end will drop downwardly and reinstall itself on the post 28. As soon as the shelf is loaded the engagement will be enhanced on the post 28**.

To assemble the structure shown in FIG. 1, the support frames 22, 22' etc., would be prefabricated according to the depth of shelf which is to be used. Once assembled, the frames are positioned and built up with the shelf support elements **42*a*, 42' etc., before bolting the frames to the floor and ceiling using the foot plates 36, 36*a* etc., and head plates 38, 38*a*** etc. This is because the spacing between the frames is critical and consequently it is easier to place the bolts after assembly than it would be to attempt to assemble the structure after bolting the frames individually to the floor. Of course, in some instances it will not be necessary to use the head plates and possibly not the foot plates although these latter plates would normally be used.

With the frame 22 in position and the frame 22° located as near as possible in its position, the shelf supporting elements **24*a*, 24*a*', and 24*b*, 24*b*' are engaged in position where shelves are to be located. It will be evident that because both ends of a shelf support element are engaged simultaneously, the openings (such as openings 64**) must be sufficiently wide to allow the extreme ends of the coupling elements to pass into the openings. These elements are inclined due to the divergence between the first and second portions of the end connectors so that this clearance must be provided. Alternatively the shape of the coupling elements or second positions could be changed to facilitate assembly in any suitable manner.

After assembly of the shelf support elements, the frames 22 and 22' can be bolted in position and the operation repeated to locate and install the frame 22". After installation of the frame, the heights of the shelves can be changed by removing the shelves and removing the corresponding shelf support elements before relocating these elements at a different position on the corresponding posts.

Reference is now made of FIG. 7 which illustrates an alternative embodiment of post and end connector. In this embodiment, a post 86 is somewhat similar in shape to the post 28 but differes in that the centre portion 58 of post 28 is wider than a corresponding centre portion 88 of the post 86. In the FIG. 7 embodiment the centre portion 88 is perforated by a series of slots 90 each of which is sufficiently wide to receive an end connector 92 (which is similar to end connector **42*a*) as well as a corresponding end connector of a further shelf supporting element. For instance, if the embodiment shown in FIG. 7 were used in FIG. 1, where the end connectors 42*a* and 42*c* meet the post 28', then the end connectors 42*a*, 42*c*** would be engaged in the same slots in the post.

The post 86 has advantages over the post 28 in that it requires less material and there are half as many slots to be punched. However, some rigidity is lost due to the reduced cross-section and it would be matter of preference which of the two embodiments of the post are used in a particular installation.

FIG. 7 also illustrates a stringer 94 made of the same cross-section as the post 86. The shelf is supported positively between the inwardly facing flanges which correspond to the flanges 60, 62 shown in FIG. 2 on post 28.

Also, the end connector 92 has only two coupling elements for engagement in slots 90. In general the number of these elements is a matter of preference. However, the larger loads will require more elements to spread the bearing load over a greater surface area.

Reference is now made to FIG. 8 which illustrates a further embodiment of a post and an end connector. In this embodiment the numerals for these parts which correspond to parts described with reference to FIG. 2 will be raised by one hundred, i.e. **140*a* will correspond with 40*a* etc. It will be seen that this embodiment differs from that shown in FIG. 2 in that the portions 168 and 172 of the end connector 142*a* are parallel and outer portion 144 and side portion 154 of the post 128 are also parallel. In this embodiment these parallel parts slide closely over one another on assembly and the wedging action of the coupling elements brings the front portion 170 into firm face-to-face engagement with the front portion 148 of the post 128**.

There are a number of features in the construction of the parts of the rack system 20 which result in the advantages for this structure over prior art structures. The wedging action created by the rearward face 84 of the first coupling element 74 and the corresponding faces on the coupling elements **76, 76*a* combine with the wedging action as the end connector 42*a* engages the outer portion 44 and side portion 54 of the post 28** results in a positive lock which retains the parts in their relative positions.

A further feature is that the perforations creating the slots 64 (FIG. 2) and the slots 90 (FIG. 7) lie generally at the neutral axis of the posts 28, 86. Consequently the perforations have little effect on the strength of the post because of any bending situation the stress at the neutral axis is minimal. The metal at the neutral axis is therefore available to carry the load of the shelf in vertical compression so that the maximum strength is achieved in a rolled section of moderate wall thickness.

A further advantage of the structure is that because the cross-section of the posts allows the braces 30, 32, and 34 (FIG. 1) to be inserted between the flanges 60, 62 (FIG. 2) and welded in place, the braces do not interfere with the shelf space.

What I claim as my invention is:

1. A rack system comprising:

a plurality of upright support frames, each support frame including at least one post having first and second side ribs extending longitudinally, and a centre portion extending between the side ribs and defining longitudinally spaced slots, the side ribs being symmetrically disposed to either side of the centre portion and each side rib including an outer portion lying generally perpendicularly to a plane containing the centre portion, a front portion lying generally parallel to the centre portion, and a side portion extending from the front portion to the centre portion at a small angle of divergence with the outer portion; and shelf support elements adapted to be releasably attached to the support frames for extending horizontally in pairs between adjacent support frames to support a shelf in a horizontal position, each shelf support element comprising: a stringer and a pair of opposite-handed end connectors attached one to each of the ends of the stringer for engagement with the posts of two adjacent support frames, each end connector having a channel shape adapted to fit over a side rib of one of the posts, the channel shape being defined by first and second side portions diverging from one another be said small angle for respective surface-to-surface contact with said outer portion and said side portion, and a front portion extending between these side portions and proportioned such that with said surface-to-surface contact there is a clearance between this front portion and said front portion of said rib, the end connector being attached to the stringer by the first portion and further comprising first and second coupling elements extending rearwardly from the second portion for engagement in said slots, each of the coupling elements having a cantilever portion and a downward projection dependent from an end of the cantilever portion, the downward projection having a forward face inclined downwardly and rearwardly for engagement with a rearward side of the centre portion of one of the posts upon engaging the coupling elements in such a post, whereby a downward force on the end connector will result in a first wedging action as the rearward faces of the coupling elements ride on the centre portion thereby drawing the end connector into firm and snug engagement with the corresponding side rib of the post and a complementary second wedging action as said face-to-face engagement causes frictional locking between the post and the end connector, this second wedging action being allowed by said clearance between the respective front portion of the ribs and end connector.

2. A rack system as claimed in claim 1 in which each of the respective centre portions of the posts lies substantially on the neutral axis of the associated post.

3. In combination, a post and an end connector for use in a rack system to support shelves and the like, the post having first and second side ribs extending longitudinally and a centre portion extending between the side ribs and defining longitudinally spaced slots, the side ribs being symmetrically disposed to either side of the centre portion and each side rib including an outer portion lying generally perpendicularly to a plane containing the centre portion, a front portion lying generally parallel to the centre portion, and a side portion extending from the front portion to the centre portion at a small angle of divergence with the outer portion; the end connector having a channel shape adapted to fit over a side rib of the post, the channel shape being defined by first and second side portions diverging from one another by said small angle for respective surface-to-surface contact with said outer portion and said side portion, and a front portion extending between these side portions and proportioned such that with said surface-to-surface contact there is a clearance between this front portion and said front portion of the rib, the end connector further comprising first and second coupling elements extending rearwardly from the second portion for engagement in said slots, each of the coupling elements having a cantilever portion and a downward projection dependent from an end of the cantilever portion and having a forward face inclined downwardly and rearwardly for engagement with a rearward side of the centre portion of the post upon engaging the coupling element in the post whereby a downward force on the end connector will result in a first wedging action as the rearward faces of the coupling elements ride on the centre portion thereby drawing the end connector into firm and snug engagement with the corresponding side rib of the post and a complementary second wedging action as said face-to-face engagement causes frictional locking between the post and the end connector, this second wedging action being allowed by said clearance between the respective front portions of the rib and end connector.

4. The combination as claimed in claim 3 in which the centre portion of the post lies substantially on the neutral axis of the post.

* * * * *